US008844202B2

(12) United States Patent
Carralero et al.

(10) Patent No.: US 8,844,202 B2
(45) Date of Patent: Sep. 30, 2014

(54) LATCHING MECHANISM FOR ACCESS DOOR

(75) Inventors: Osmany M. Carralero, Miami, FL (US); Marvin Ernesto Lopez, Hialeah, FL (US); Louis S. Slimak, Penbroke Pines, FL (US)

(73) Assignee: U.S.F. Fabrication, Inc., Hialeah, FL (US)

( * ) Notice: Subject to any disclaimer, the term of this patent is extended or adjusted under 35 U.S.C. 154(b) by 0 days.

(21) Appl. No.: 13/538,315

(22) Filed: Jun. 29, 2012

(65) Prior Publication Data

US 2013/0031840 A1 Feb. 7, 2013

Related U.S. Application Data

(60) Provisional application No. 61/503,771, filed on Jul. 1, 2011.

(51) Int. Cl.

| | |
|---|---|
| ***E05D 7/06*** | (2006.01) |
| ***E05C 17/28*** | (2006.01) |
| ***E06B 1/52*** | (2006.01) |
| ***E02D 29/14*** | (2006.01) |
| *E06B 5/06* | (2006.01) |

(52) U.S. Cl.

CPC . *E05C 17/28* (2013.01); *E06B 5/06* (2013.01); *E06B 1/52* (2013.01); *E02D 29/14* (2013.01)

USPC ..... 49/400; 49/401; 49/402; 49/131; 49/381; 49/33; 16/357; 16/360; 52/19; 52/20

(58) Field of Classification Search

USPC ..... 49/400–402, 131, 381, 55, 33; 16/357, 16/360; 52/19, 20; 292/1, 262, 194, 292/DIG. 11, DIG. 15

See application file for complete search history.

(56) References Cited

U.S. PATENT DOCUMENTS

| | | | | |
|---|---|---|---|---|
| 20,679 | A | 6/1858 | Brown | |
| 195,965 | A | 10/1877 | Straight | |
| 2,249,403 | A | 7/1941 | Stollsteimer | |
| 3,820,866 | A | 6/1974 | Kaldenberg | |
| 4,133,074 | A | 1/1979 | Schack | |
| 4,163,344 | A | 8/1979 | Scherer | |
| 4,403,798 | A * | 9/1983 | Smith | 292/256.5 |
| 4,535,908 | A | 8/1985 | Dabich | |
| 5,029,362 | A | 7/1991 | Prodan | |
| 5,076,188 | A | 12/1991 | Burroughs | |
| 5,136,811 | A * | 8/1992 | Lyons, Sr. | 49/386 |
| 5,205,073 | A * | 4/1993 | Lyons, Sr. | 49/386 |
| 5,324,135 | A | 6/1994 | Smith | |
| 5,373,665 | A * | 12/1994 | Lyons, Sr. | 49/386 |
| 6,041,553 | A | 3/2000 | Joyce et al. | |
| 6,167,977 | B1 * | 1/2001 | Adamson et al. | 180/69.2 |
| 6,347,818 | B1 * | 2/2002 | Lyons, Sr. | 292/271 |

(Continued)

*Primary Examiner* — Katherine Mitchell
*Assistant Examiner* — Marcus Menezes
(74) *Attorney, Agent, or Firm* — GrayRobinson, P.A.; Michael J. Colitz, III

(57) ABSTRACT

Disclosed is a latching mechanism for a access door. More specifically, the disclosure relates to an access door that can be pivoted between opened and closed orientations and secured in the open position with the aid of a hold open arm. A latching lever, in turn, pivotally engages the hold open arm to selectively secure the access door in an opened orientation. A grip upon the hold open arm can thereafter be used in conjunction with the latching lever to release the access door and permit it to be closed.

12 Claims, 8 Drawing Sheets

(56) References Cited

U.S. PATENT DOCUMENTS 6,718,692 B2 * 4/2004 McKernan ..... 49/67
7,028,431 B2 * 4/2006 Tlemcani et al. ..... 49/8
7,337,499 B2 * 3/2008 Zhang et al. ..... 16/357
8,166,706 B2 5/2012 Slimak et al.
2005/0133107 A1 * 6/2005 Williams ..... 140/57
2010/0071528 A1 * 3/2010 Viereck et al. ..... 83/861

* cited by examiner

LATCHING MECHANISM FOR ACCESS DOOR

CROSS-REFERENCE TO RELATED APPLICATION

This application is a continuation of and claims priority to provisional application Ser. No. 61/503,771 filed on Jul. 1, 2011, and entitled "Locking Mechanism for Vault Door." The contents of this application are fully incorporated herein for all purposes.

BACKGROUND OF THE INVENTION

1. Field of the Invention

This invention relates to a latching mechanism for an access door. More particularly, the present invention relates to a latching mechanism for maintaining an access door in an opened orientation.

2. Description of the Background Art

Access doors are frequently mounted within the ground and used to access underground utility areas. Because utility areas are often located in highly trafficked areas, the access doors must be capable of withstanding pedestrian and/or vehicle traffic. Access doors also serve an important security function by preventing unauthorized individuals from entering the utility areas. As a result, access doors must employ a heavy duty construction in order to both support traffic and provide security.

Users entering the utility area must ensure that the access door is fixed in an open position during ingress and egress. Access doors that are not properly secured can be unintentionally closed, thereby injuring the user. Given the substantial weight of typical access doors, these injuries can be substantial.

An example of a prior art vault, or access, door is disclosed in U.S. Pat. No. 4,133,074 to Schack. Schack discloses a spring assisted door construction. The door of Schack includes closed, raised, and fully open positions. A first pair of torsion rods are arranged to be loaded when the door is swung down to a closed position from a raised position. A second pair of torsion bars are arranged to be stressed when the door is swung to its fully open position.

Yet another example is illustrated in U.S. Pat. No. 6,347,818 to Lyons, Sr. Lyons discloses a hold open arm assembly for a non-vertically hinged door. The assembly permits one-handed operation and prevents the door from closing unexpectedly. The assembly utilizes a guide bracket with a guide slot. The assembly further includes a hold open arm having a nut, bolt, bearing, and stop surface at one end. The bearing is adapted to travel within with guide slot. The stop surface cooperates with an angled stop to lock in door in an opened orientation.

Although Schack and Lyons address issues associated with the weight of the door, they nonetheless do not provide an adequate latching mechanism for a hold open arm. The present disclosure is directed to a latching mechanism for a hold open arm in order to prevent unintended closure of the door.

SUMMARY OF THE INVENTION

One of the advantages of the present disclosure is realized by providing an access door that can be secured in a fully opened orientation.

Another advantage is achieved by latching a hold open arm in a pivoted orientation to secure an attached access door in an opened orientation.

Still yet another advantage is achieved by permitting a user to close an access door by releasing the hold open arm.

A further advantage is realized by a hold open arm with a secondary latching lever, whereby the latching lever includes a cam that pivotally engages and secures a pin upon the hold open arm.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

Similar reference characters refer to similar parts throughout the several views of the drawings.

| PARTS LIST | |
|---|---|
| 20 | Latching Mechanism |
| 22 | Frame |
| 24 | Access Door |
| 24a | Edges of Access Door |
| 26 | Hold Open Arm |
| 28 | Secondary Latching Lever |
| 32 | Forward End of Frame |
| 34 | Rearward End of Frame |
| 36 | Sidewalls of Frame |
| 38 | Flanges on Frame |
| 42 | Hinges for Access Door |
| 44 | Inner Edge of Access Door |
| 46 | Slotted Track |

-continued

| PARTS LIST | |
|---|---|
| 48 | First End of Slotted Track |
| 52 | Second End of Slotted Track |
| 54 | First Latching Recess |
| 56 | Second Latching Recess |
| 56a | Peripheral Edge of Recess |
| 58 | Hold Open Arm Positioning Pin |
| 62 | Cylindrical Body of Positioning Pin |
| 64 | Enlarged Head of Positioning Pin |
| 66 | Handle of Latching Lever |
| 68 | Arcuate Opening |
| 72 | Ends of Arcuate Opening |
| 74 | Cam |
| 76 | Pivot Pin |
| 78 | Grip Portion Hold Open Arm |

DETAILED DESCRIPTION OF THE PREFERRED EMBODIMENT

The present disclosure relates to a latching mechanism for an access door. More specifically, the disclosure relates to an access door that can be pivoted between opened and closed orientations, and secured in the open position with the aid of a hold open arm. A latching lever, in turn, pivotally engages the hold open arm to selectively secure the hold open arm, maintaining the access door in an opened orientation. A grip upon the hold open arm can thereafter be used in conjunction with the latching lever to unlock the access door and permit it to be closed.

Figure 1A:
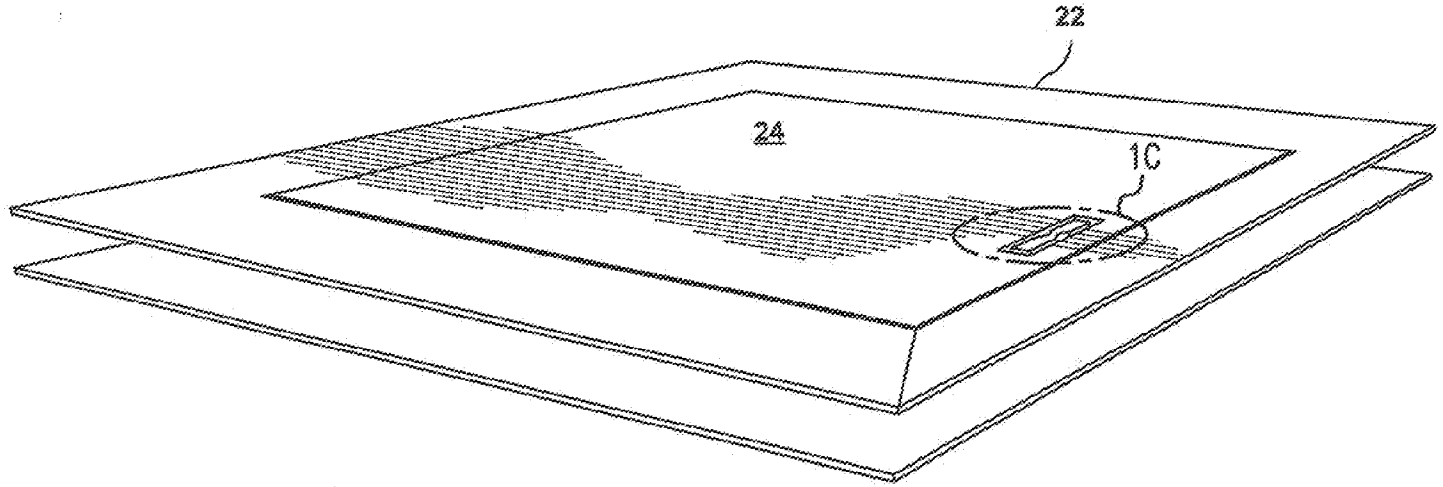
FIG. 1A is a perspective view of the access door in its closed orientation.
Figure 1C:
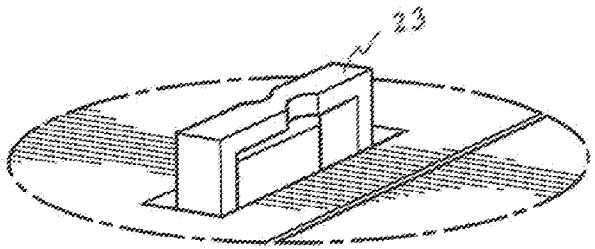
FIG. 1C is a detailed view of the handle for the access door as taken from FIG. 1A.
Figure 1B:
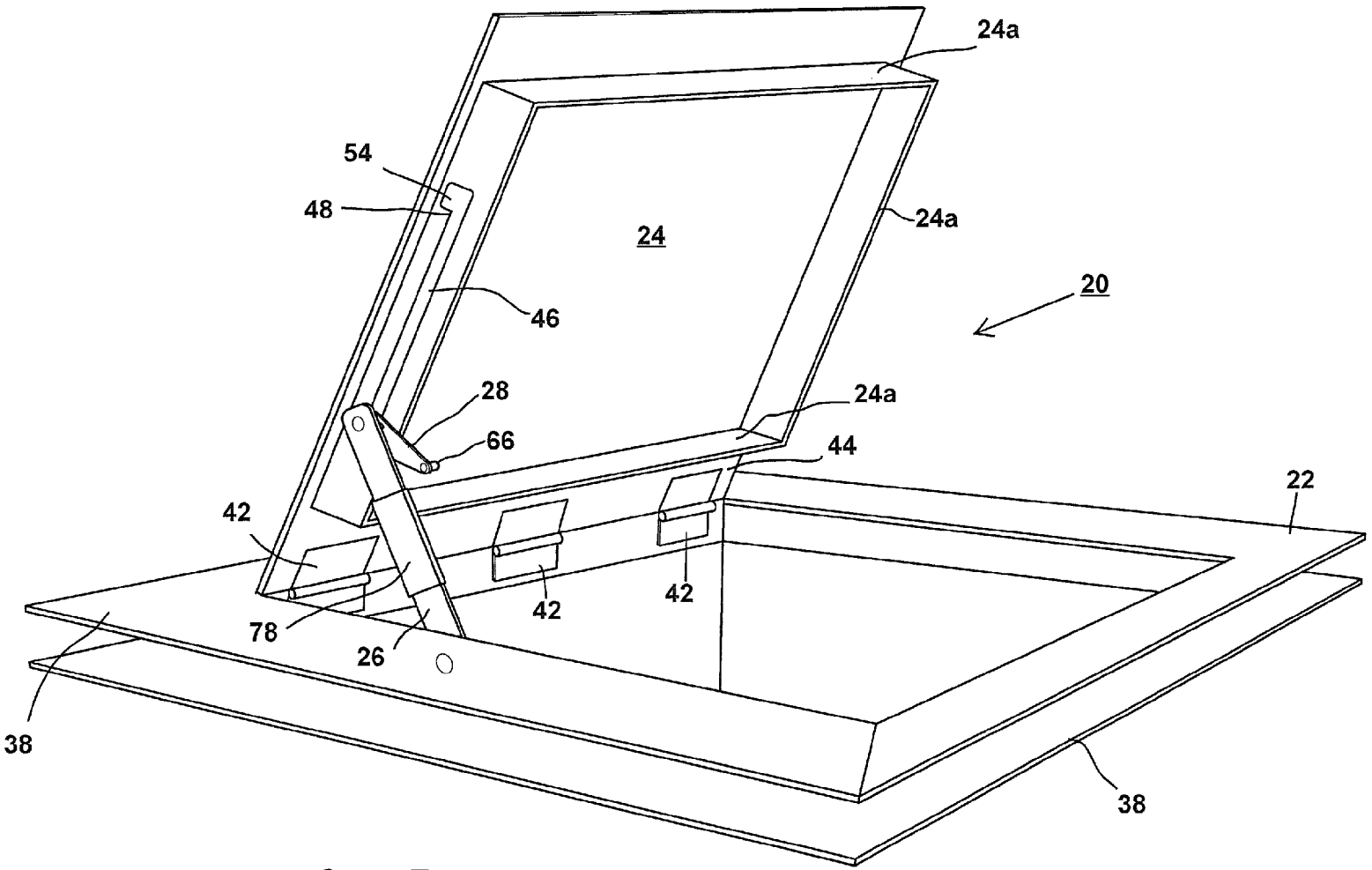
FIG. 1B is a perspective view of the access door and latching mechanism and with the access door in the opened orientation.
Figure 2:
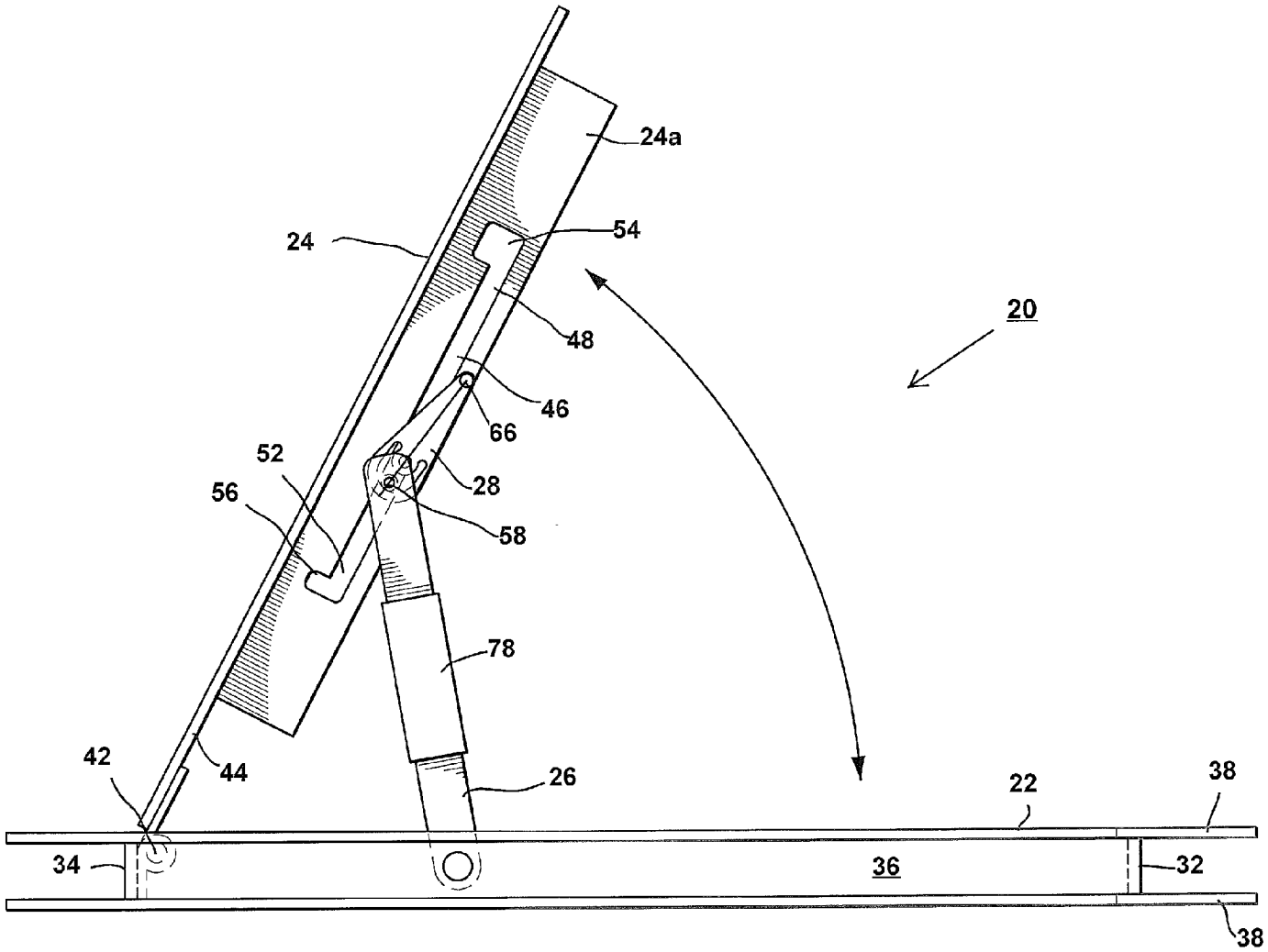
FIG. 2 is a side elevational view of the access door in the partially opened orientation and with the latching mechanism unlocked.

With reference to FIG. 1B, latching mechanism 20 of the present disclosure is illustrated. As illustrated, mechanism 20 comprises a frame 22, an access door 24, a hold open arm 26, and a latching lever 28. FIG. 1A illustrates access door 24 in the closed orientation covering, for example, an underground utility area. Access door 24 may include a recessed handle 23 for use in lifting the door opened (note FIG. 1C). With reference again to FIG. 1B, access door 24 is pivotally secured to frame 22 via hinges 42. Hold open arm 26, in turn, is slidably secured to door 24 and pivotally secured to frame 22. Frame 22 in the depicted embodiment is rectangular and defines an opening for an underground utility enclosure or access. As most clearly illustrated in FIG. 2, frame 22 includes four walls: forward and rearward walls (32 and 34); and two side walls 36. Frame 22 optionally includes upper and lower peripheral flanges 38 that permit frame 22 to be mounted flush within the ground.

Access door 24 is pivotally secured to one of the walls of frame 22. In the depicted embodiment, access door 24 is rectangular to match the rectangular opening of access and is further attached to the rear wall 34 of frame 22 by way of hinges 42. Hinges 42 are pivotally secured between frame 22 and an inner edge 44 of door 24. As depicted in FIG. 1B, door 24 has a series of edges 24*a* that are offset from the periphery of door 24. These edges 24*a* are adapted to be received within the access opening when door 24 is closed. A slotted track 46 is formed within one of the recessed 24*a*. In the depicted embodiment, slotted track 46 is formed on a side edge and includes first and second ends (48 and 52). Additionally, first end 48 includes a first latching recess 54 and second end 52 includes a second latching recess 56 (note FIG. 2). Both latching recesses (54 and 56) are perpendicular to the length of slotted track 46. Slotted track 46 is adapted to engage a hold open arm positioning pin 58 upon hold open arm 26 in a manner more fully described hereinafter.

Figure 7:
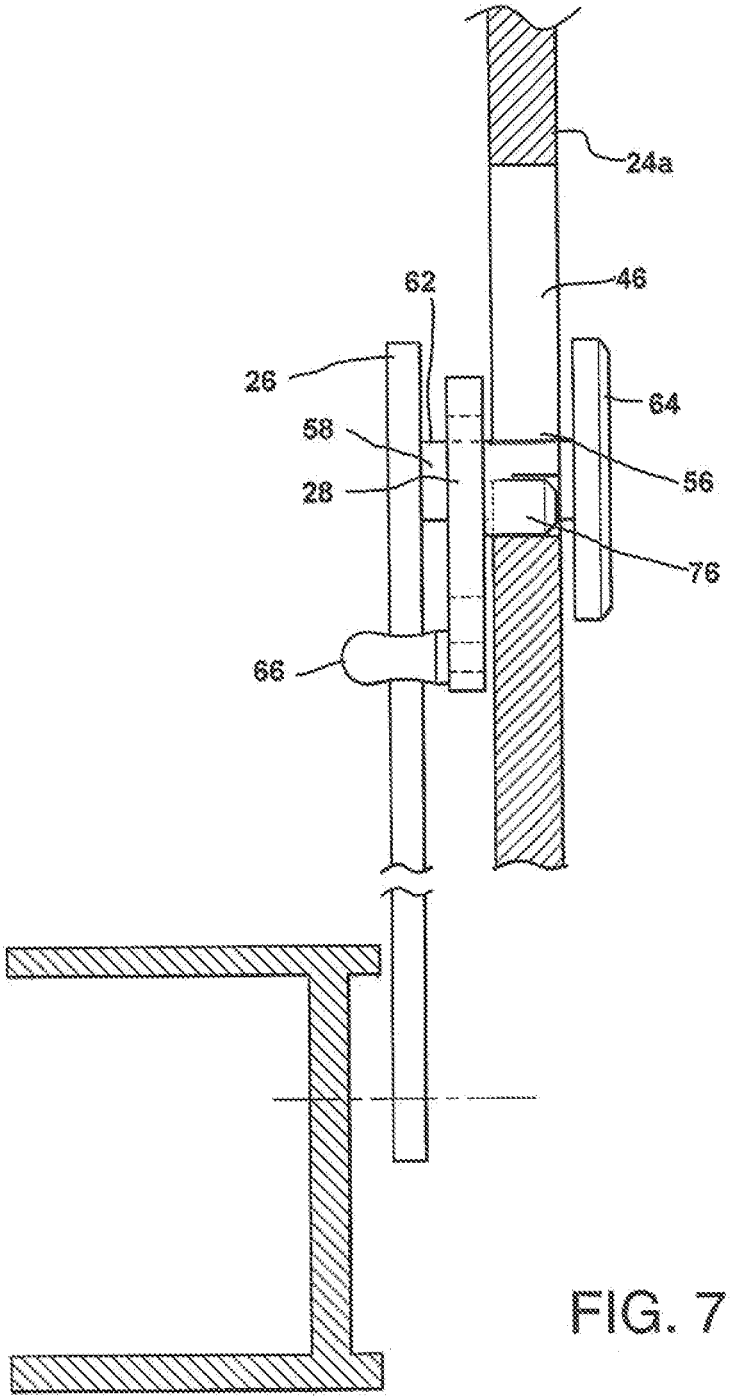
FIG. 7 is a cross sectional view taken along line VII-VII of FIG. 6.
Figure 8:
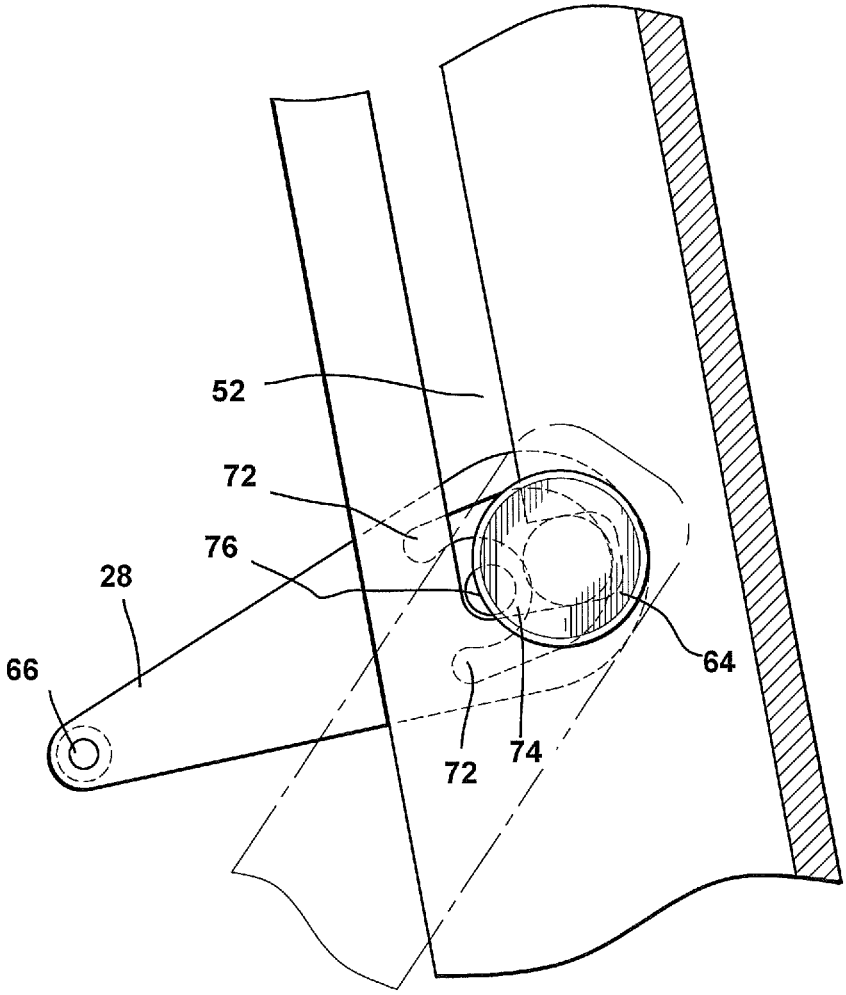
FIG. 8 is a detailed view of the locking mechanism in the locked position.

Hold open arm 26 includes a first end pivotally secured to frame 22 and a second end slidably interconnected to slotted track 46. The first end is pivoted at a fixed point, and second end is pivoted such that it is free to move linearly along slotted track 46. In the depicted embodiment, a threaded fastener forms the pivotal interconnection between frame 22 and hold open arm 26. The second end of the hold open arm 26 includes a positioning pin 58 at its distal end. Positioning pin 58 comprises a cylindrical body 62 and an enlarged head 64 (note FIG. 7). The width of head 64 is larger than the opening of track 46 to prevent the removal of pin 58. The slidable connection between hold open arm 26 and slotted track 46 is achieved by positioning cylindrical body 62 of positioning pin 58 within slotted track 46. This permits positioning pin 58 and hold open arm 26 to freely travel along the entire length of slotted track 46. Positioning pin 58 can be positioned within recesses 54 and 56 at either end of track 46. As cylindrical body 62 rides within the interior of the slotted track 46, the enlarged head 64 travels along the outer surface of recessed edge 24*a*.

Figure 6:
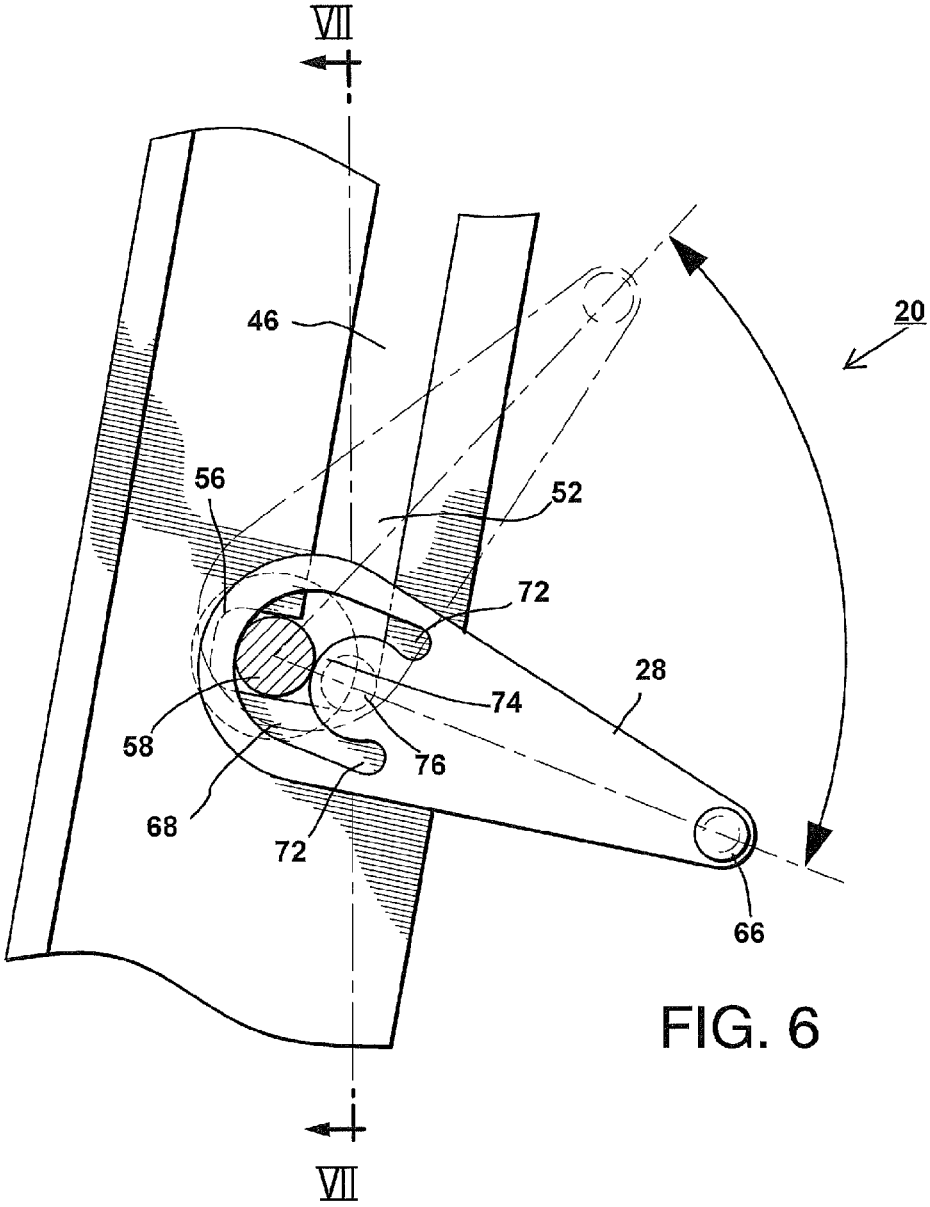
FIG. 6 is a detailed view of the locking mechanism in the locked position and with the unlocked position being shown in phantom.

Latching lever 28 can be used by the operator to selectively lock positioning pin 58 into the second latching recess 56 at the second end 52 of track 46. As best illustrated in FIG. 6, latching lever 28 has opposed ends with a handle 66 interconnected to the first end and an arcuate, or semicircular, opening 68 formed in the second end. Lever 28 is preferably tapered with a narrow end adjacent handle 66 and a larger end at opening 68. Handle 66 has two halves extending perpendicularly from the surface of lever 28. Handle 66 can be enveloped by a rubber cover.

Figure 5:
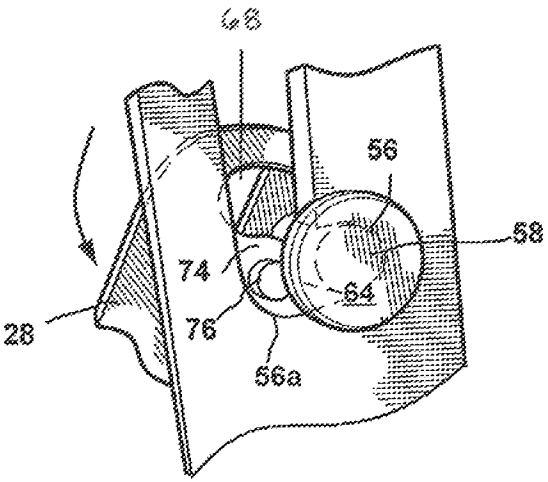
FIG. 5 is a detailed view of the locking mechanism in the locked position.
Figure 4:
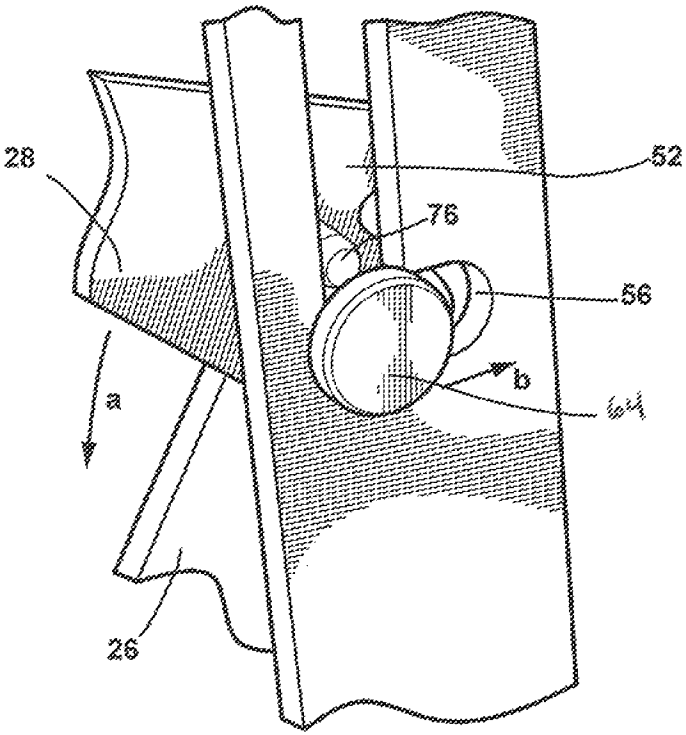
FIG. 4 is a detailed view of the locking mechanism being moved into the locked position.

Arcuate opening 68 is defined by curved ends 72 and a central cam 74 (note FIG. 4). A pivot pin 76 is formed upon cam 74. Pivot pin 76 is slideably received within slotted track 46 at a location adjacent positioning pin 58. Positioning pin 58 of the hold open arm 26 is secured within both slotted track 46 and arcuate opening 68 of latching lever 28. Latching lever 28 can, therefore, pivot about positioning pin 58 as positioning pin 58 travels within track 46. Latching lever 28 is parallel with hold open arm 26. Handle 66 on lever 28 acts as a counterweight such that lever 28 has a tendency to rotate into a position with handle 66 pointing toward the ground. This assists in keeping lever 28 in the locked position. Namely, as illustrated in FIG. 5, the weight of handle 66 will rotate lever 28 downwardly such that cam 74 prevents positioning pin 58 from leaving latching recess 56.

Access door 24 has closed and opened orientations. In the closed orientation, door 24 overlies frame 22 to close the entrance to the access (note FIG. 1A). Thus, the angle between door 24 and frame 22 is 0°. To achieve this orientation the pivot and positioning pins (76 and 58) are slid to the first end 48 of slotted track 46. As illustrated, the first end 48 of slotted track 46 is the end closest to the forward end 32 of frame 22. Second end 52 of slotted track 46 is the end closest to the rearward end (or hinge end) 34 of frame 22. In the closed orientation positioning pin 58 is adjacent to the first end 48 of slotted track 46. Pin 58 and pivot 76 may optionally rest within first latching recess 54 in the closed orientation.

Figure 3:
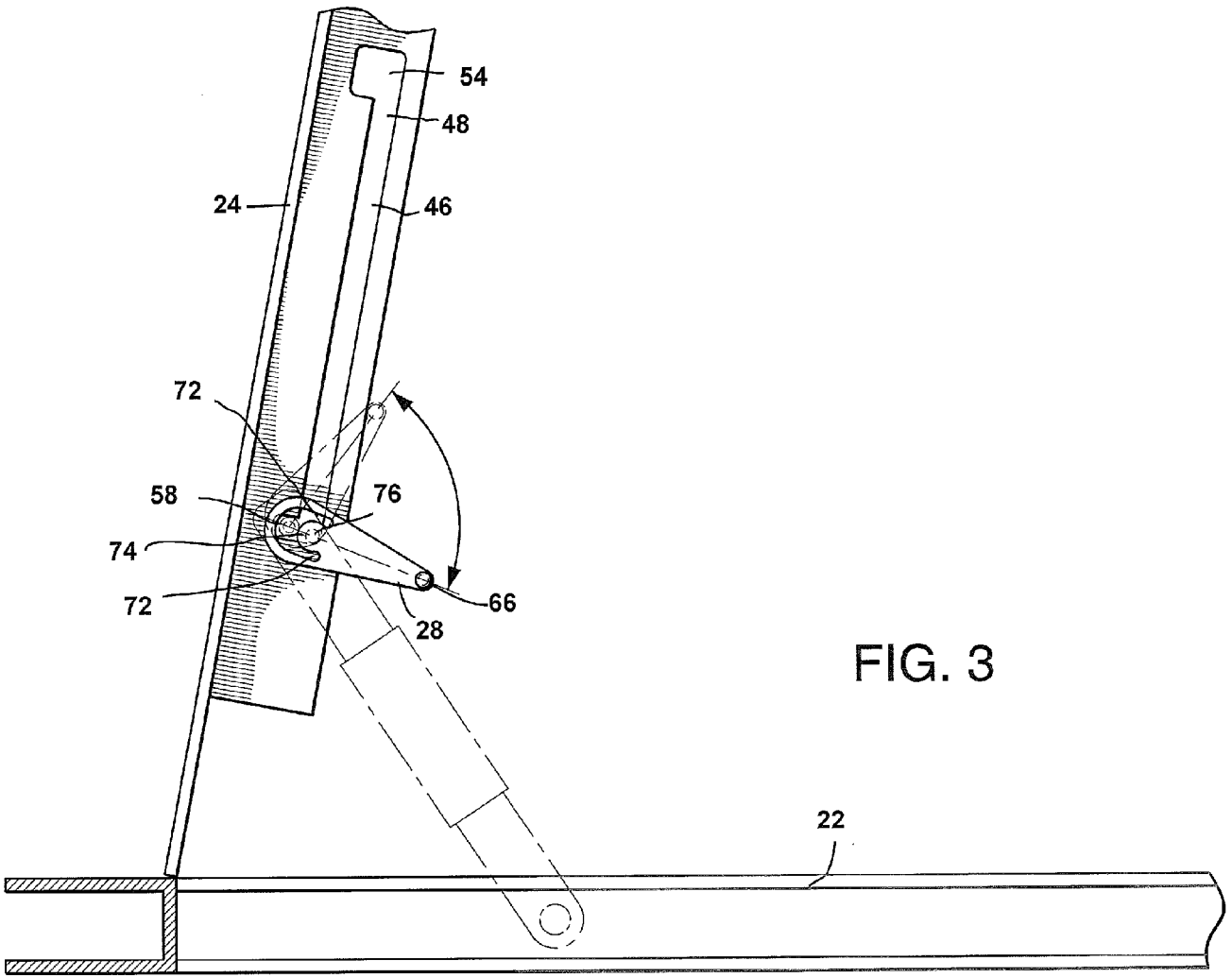
FIG. 3 is a side elevational view of the access door in the opened orientation and the latching mechanism locked; the phantom view shows the latching mechanism unlocked.

In the opened orientation depicted in FIG. 3, access door 24 is positioned at an angle with respect to frame 22. In the depicted embodiment, the open position is achieved when the access door 24 is at approximately a 90° angle with respect to frame 22. This angle is measured from the plane in which frame 22 is mounted. Although a 90° orientation is preferred, angles between 85° to 95° can likewise constitute an opened orientation. The only requirement is that the opening be sufficient to allow ingress and egress. Access door 24 is preferably secured into the opened orientation prior to a user entering or exiting the access.

The door is placed into the open position by sliding the hold open arm 26 such that the positioning and pivots pins (58 and 76) are moved to the second end 52 of slotted track 46. In this position, access door 24 is propped into a fully opened but not yet a fully secured position. As noted in FIG. 4, access door 24 is locked by moving the first end of the latching lever 28 towards the hold open arm 26. The "a" arrow in FIG. 4 shows the direction lever 28 travels when moving to the locked position. As this occurs, and as illustrated in FIG. 5, latching lever 28 pivots about pivot pin 76 and cam 74 engages positioning pin 58. Upon further rotation of latching lever 28 the cam 74 urges positioning pin 58 into the latching recess 56. Pivot pin 76 may be leveraged against the peripheral wall 56*a* of recess 56 while this occurs. In the final locked position (note FIG. 6) cam 74 prevents positioning pin 58 from being removed from latching recess 56. With the latching lever 28 fully rotated, latching lever 28 and hold open arm 26 may be nearly parallel with one another. In this orientation, the unintended closure of access door 24 is prevented. Lever 28 is also counterweighted such that it rotates to the locked position. The mass of the overall system is such that gravity tends to rotate hold open arm 26 and latching lever 28 and into a position wherein access door 24 is opened and mechanism 20 is locked.

To release the access door 24 for closure, latching lever 28 is pivoted in the opposite direction. Namely, the latching lever 28 is pivoted away from hold open arm 26. As the latching lever 28 is pivoted in this direction, the cam 74 is moved from its position over the second recess 56, which permits the positioning pin 58 to be removed from the latching recess 56. More specifically, the user can grasp the grip portion 78 of the hold open arm 26 and pivot the arm 26 away from door 24. The user may also optionally push back on the access door 24. This action allows the hold open arm 26 to be released from its locked position. This action also places the positioning pin 58 and the pivot pin 76 back into slotted track 46 and out of the latching recess 56. Both the positioning and pivot pins (58 and 76) are then free to slide to the opposite end 48 of slotted track 46 as door 24 is pivoted to the closed orientation.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A latching mechanism for an access door comprising:

a frame defining a rectangular opening, the frame having rearward and forward walls and upper and lower mounting flanges;

an access door pivotally connected to the rearward wall of the frame, the access door having first and second opposing faces, a recessed inner edge upon the first face, a handle slidably positioned within the access door, a slotted track formed within the recessed inner edge and including a latching recess;

a hold open arm having first and second ends and an intermediate extent therebetween, the first end pivotally secured to the frame, a positioning pin secured to the second end, a grip positioned along the intermediate extent, the positioning pin having a cylindrical body and a head, the cylindrical body being slidably received within the slotted track;

a latching lever having first and second ends, a handle positioned upon the first end of the latching lever and an arcuate opening formed in the second end of the latching lever, the arcuate opening having first and second extents and a centrally formed cam, a pivot pin formed upon the centrally formed cam, the pivot pin being slidably received within the slotted track;

the access door having a closed orientation wherein the access door covers the frame, the access door having an opened orientation wherein the access door is positioned at approximately a 90 degree angle to the frame, the access door being secured into the opened orientation by rotating the first end of the latching lever towards rearward wall of the frame and whereby rotation of the cam urges the positioning pin into the latching recess.

2. A latching mechanism for an access door comprising:

a frame defining an opening;

a door pivotally connected to the frame, a slotted track formed within an edge of the door, the slotted track having first and second ends;

a hold open arm having first and second ends and an intermediate extent therebetween, the first end of the hold open arm pivotally secured to the frame, a positioning pin secured to the second end of the hold open arm and being slidably received within the slotted track;

a latching lever having first and second ends and a centrally formed cam, the latching lever being pivotally secured to the slotted track;

the door having an opened orientation wherein the door is positioned at an angle to the frame, the door being locked into the opened orientation by pivoting the first end of the latching lever whereby the cam rotates and secures the positioning pin into the second end of the slotted track; wherein the slotted track has first and second latching recesses and wherein the cam can be rotated by way of the latching lever to urge the positioning pin into the second recess to secure the door; wherein a pivot pin formed on the cam slides within the second recess at a location adjacent to the positioning pin to urge the positioning pin into the second recess to secure the door in the open orientation.

3. The latching mechanism as described in claim 2 wherein the positioning pin comprises a cylindrical body and a head and wherein the cylindrical body rides within the slotted track and the head rides along the slotted track.

4. The latching mechanism as described in claim 2 wherein the door is horizontal when closed.

5. The latching mechanism as described in claim 2 wherein in the opened orientation the door forms an angle of between approximately 85° to 95° with respect to the frame.

6. The latching mechanism as described in claim 2 wherein the latching lever rotates about the pivot pin to be brought into locked and unlocked orientations.

7. The latching mechanism as described in claim 2 wherein the latching lever includes an arcuate opening with first and second ends, and wherein the cam is formed between the first and second ends of the arcuate opening.

8. The latching mechanism as described in claim 7 wherein the positioning pin is in one of the ends of the arcuate opening when the door is released.

9. The latching mechanism as described in claim 7 wherein the positioning pin is between the first and second ends of the arcuate opening when the door is secured.

10. An access door for an enclosure, the access door comprising:

a frame defining an opening for the enclosure;

a door pivotally connected to the frame, a track formed within an edge of the door, the track having a latching recess;

a hold open arm having first and second ends and an intermediate extent therebetween, the first end pivotally secured to the frame, the second end including a positioning pin that is slidably received within the track;

a latching lever having first and second ends and a cam, the latching lever is interconnected to the track;

the door having an opened orientation wherein the door is positioned at an angle to the frame, the door being secured into the opened orientation by moving the first end of the latching lever whereby the cam rotates to lock the positioning pin within the latching recess, wherein the track is defined by opposing edges and the latching lever further comprising a pivot pin located on the cam, the pivot pin rotating against one of the opposing edges of the track as the cam locks the positioning pin within the latching recess.

11. The access door as described in claim 10 wherein the latching lever has an end comprising a counterweight and wherein the counterweight rotates the cam to lock the positioning pin within the latching recess.

12. The access door as described in claim 10 further comprising an arcuate opening located about the cam and wherein the positioning pin is located within the arcuate opening.

* * * * *